United States Patent [19]

Brach

[11] Patent Number: 4,680,951

[45] Date of Patent: Jul. 21, 1987

[54] METHOD FOR DRESSING HOT ROLLED STRIP COILS, ESPECIALLY COILBOX COILS

[75] Inventor: Reiner Brach, Mülheim, Fed. Rep. of Germany

[73] Assignee: Reiner Brach Import-Export, Mülheim, Fed. Rep. of Germany

[21] Appl. No.: 749,399

[22] Filed: Jun. 27, 1985

[30] Foreign Application Priority Data

Jun. 28, 1984 [DE] Fed. Rep. of Germany ..... 3423760
Aug. 1, 1984 [DE] Fed. Rep. of Germany ..... 3428349
Apr. 17, 1985 [DE] Fed. Rep. of Germany ..... 3513831

[51] Int. Cl.[4] ..... B21D 3/04

[52] U.S. Cl. ..... 72/160; 72/129; 72/252; 242/78.6; 242/78.8; 226/92

[58] Field of Search ..... 72/160, 183, 252, 250, 72/129; 242/78.6, 78.7, 78.8; 226/92

[56] References Cited

U.S. PATENT DOCUMENTS 2,331,392 10/1943 Haig ..... 72/252
2,494,399 1/1950 McCleary ..... 72/183
3,182,477 5/1965 Gerst ..... 72/183
3,833,161 9/1974 Krumbein ..... 226/92
3,991,951 11/1976 Galletti ..... 242/78.6
4,214,467 7/1980 Sankaran ..... 226/92
4,520,645 6/1985 Ross et al. ..... 72/183
4,552,299 11/1985 Sendzimir ..... 29/33 B

FOREIGN PATENT DOCUMENTS 1315815 5/1973 United Kingdom ..... 29/33 P
1348377 3/1974 United Kingdom ..... 72/183

*Primary Examiner*—Daniel C. Crane
*Attorney, Agent, or Firm*—Becker & Becker, Inc.

[57] ABSTRACT

A method and apparatus for dressing coils of hot rolled strips, especially coilbox coils. A coil is placed in a coil support frame in such a way that it is rotatably supported about its axis. The coil frame is capable of taking up traction forces which act upon the hot strip. The traction mechanism of a traction device is secured to the end of the strip at the beginning of the coil. The strip is at least partially uncoiled from the coil via the traction mechanism. The thus uncoiled beginning of the strip is introduced into a roller truing machine until the strip is grasped by the truing rolls of the roller truing machine and is drawn into the latter.

14 Claims, 8 Drawing Figures

METHOD FOR DRESSING HOT ROLLED STRIP COILS, ESPECIALLY COILBOX COILS

BACKGROUND OF THE INVENTION

1. Field of the Invention

The present invention relates to a method and apparatus for dressing hot rolled strip coils, especially coilbox coils. In hot wide strip mills or roll trains having a roughing train (consisting of one or more roughing stands), a following intermediate roller conveyer, and a subsequent finishing train, the slabs or blooms, which are heated in furnaces to the desired rolling temperature, and which can have, for example, a length of 9 m or more and a thickness of 100 to 170 mm or more, are first rolled in the roll stands of the roughing train into a rough strip having a thickness of 16 to 25 mm, or even up to 50 mm or more, and a width of for example 180 to 750 mm or more. This rough strip is then fed via the intermediate roller conveyer to the finishing train, in which it passes continuously, in succession, through several roll stands; in doing so, according to need, the rough strip is rolled out into a hot wide strip having a 1 to 12.5 mm thickness and, in conformity to the width of the roll stands, a width of about 550 to 2000 mm or even more. Depending upon the thickness and width of the hot strip, and the size of the initial blooms, the hot-rolled wide strip has a length of 750 to 1500 m or more. This long hot strip, which leaves the finishing train at temperatures above 800° C., is therefore subsequently wound up by a reel into a coil and then cooled down on a cooling and delivery roller conveyer.

2. Description of the Prior Art

If the coils are not supplied directly as hot-rolled wide strip coils, as the product of the hot wide strip train, to subsequent users, for example cold-rolling mills, further handling, called dressing, takes place in a hot-strip dressing unit. By way of example, the wide strip, in a longitudinal dividing unit, is again unwound from the coil, trued, trimmed at the edges, and divided longitudinally into a medium strip or a narrow strip which is wound up again into coils. Alternatively, in transverse dividing units, the hot wide strip is unwound from the coil, trued, trimmed, and cut off into plates which are taken off in packs. Truing machines are used for the truing, for example roller truing machines, which have, for example, 11 to 17 rollers for heavy plates, medium plates, and thin plates, that is, according to plate thickness. For the trimming and division of the wide strip, shears or flame cutting units are used, depending upon the thickness. The unwinding of the coils, which precedes the above-mentioned further handling of the hot wide strip, takes place in a so-called uncoiling unit in which first in a coil-opening station the beginning of the strip of the hot-strip coil is bent open by means of a coil opener. Thereupon, the coil is received by an unwinding reel which is provided with a driven drive apparatus which pushes the beginning of the strip out of the reel and feeds it to a truing apparatus. These known uncoiling units can uncoil coils with the usual sheet or plate thickness of from about 1 or 1.5 to 13 or 16 mm, and singly even up to a maximum of 25 mm. Hot wide strips having greater thicknesses are not usual, and the known uncoiling apparatus are also not in a position to unwind cold coils having a greater plate thickness.

For technical reasons in rolling, in hot wide strip trains a so-called coilbox, into which the rough strip coming from the roughing stands is introduced, and in which it is wound into a coil, is frequently arranged between the roughing train and the finishing train. The coilbox, which is provided with appropriate drive systems, unwinds the coil again and feeds it to the finishing train. In the case of brief interruptions of operation, the coil can remain in the coilbox up to at most about 15 minutes. If the interruption lasts longer, too great a temperature loss occurs in the coiled rough strip, so that due to the fully continuous progress of operation of the hot wide strip train, the coil can no longer be handled further in the finishing train. These coils of cooled or cold rough strip, which can no longer be processed on the hot wide strip train, will hereinafter be called coilbox coils.

In heavy machine construction, for example, plates are required which, with a thickness in the range for example of 25 to 50 mm, lie far above the plate thickness of hot wide strip which is rolled on hot wide strip trains in general in thicknesses of 1 to 16 mm, and singly up to 25 mm. These thick plates having a thickness of 25 mm or more are rolled as a rule on four-high trains. Moreover, plates of this thickness, which however possess only a limited utility, occur as what is called roughing stand plate in hot wide strip trains without a coilbox if, in the case of the above-mentioned operating interruptions in the finishing train, the rough strip coming from the roughing stands of the roughing train cools so much that it can no longer be processed further on the finishing train, and if then this rough strip is cut off to so-called roughing stand plates. The only practical and possibly useful utilization of the coilbox coils would therefore be to uncoil them, true them, and cut them off into roughing stand plates of the desired size. The truing and division would be quite possible with the aid of roller truing machines and flame cutter units of the above-mentioned known style of construction for the dressing of hot strip coils. However, as already stated above, the known uncoiling units can uncoil only hot strip coils having the usual plate thickness of up to 13 mm, and at most up to 25 mm, and is not capable of processing coils with greater strip thicknesses. Uncoiling units which would render it possible to uncoil coilbox coils having a strip thickness of 25 to 50 mm do not exist, because such units in the traditional style of construction of the known uncoiling equipment would be so enormously expensive that such high and extensive investment would be completely uneconomical for the relatively low output of coilbox coils. Therefore, the coilbox coils occurring in hot wide strip trains are scrapped.

An object of the present invention therefore is to provide a method and an apparatus for dressing hot strip coils, especially coilbox coils, which render it possible to uncoil and true coilbox coils, but likewise also other hot strip coils, with technically simple and relatively cheap means, at such favorable cost that the material which previously was of only scrap value can be exploited as usable and salable roughing stand plate.

BRIEF DESCRIPTION OF THE DRAWINGS

This object, and other objects and advantages of the present invention, will appear more clearly from the following specification in conjunction with the accompanying drawings, in which.

The inventive method for dressing coils of hot rolled strips, especially coilbox coils, is characterized primarily in that the coil is placed into a coil frame in such a way that it is rotatably supported about its axis in the coil frame such that the latter is capable of taking up traction forces which act upon the hot strip; in that a traction means of a traction device is secured to the end of the strip end at the beginning of the coil; in that the hot strip is uncoiled at least partially from the coil by means of the traction means; and in that the thus uncoiled beginning of the strip is introduced into a roller truing machine until it is grasped by the truing rolls of the roller truing machine and is drawn into the latter.

The inventive dressing apparatus for hot strip coils, especially coilbox coils, is characterized primarily by a coil frame for receiving a coil which is to be uncoiled; the coil frame has a mounting for the coil such that the coil is rotatable about its axis; the mounting is capable of taking up traction forces which act upon the hot strip.

DESCRIPTION OF PREFERRED EMBODIMENTS

Figure 1:
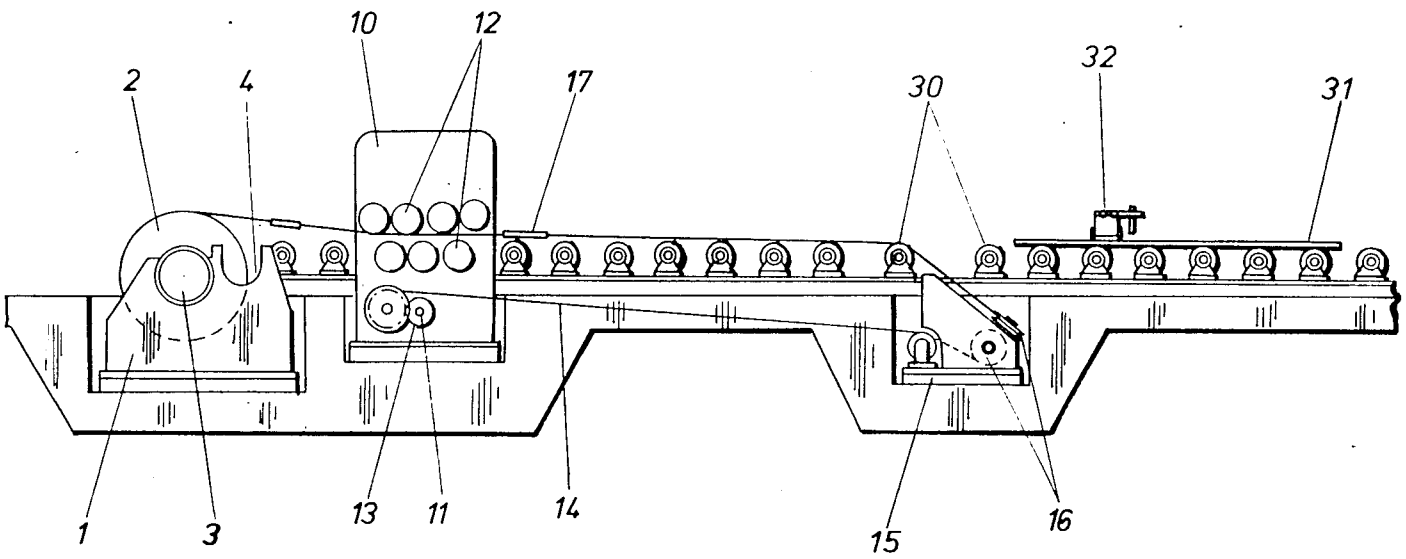
FIG. 1 is a diagrammatic side elevational view of a first exemplary embodiment of an apparatus for carrying out the inventive method.
Figure 2:
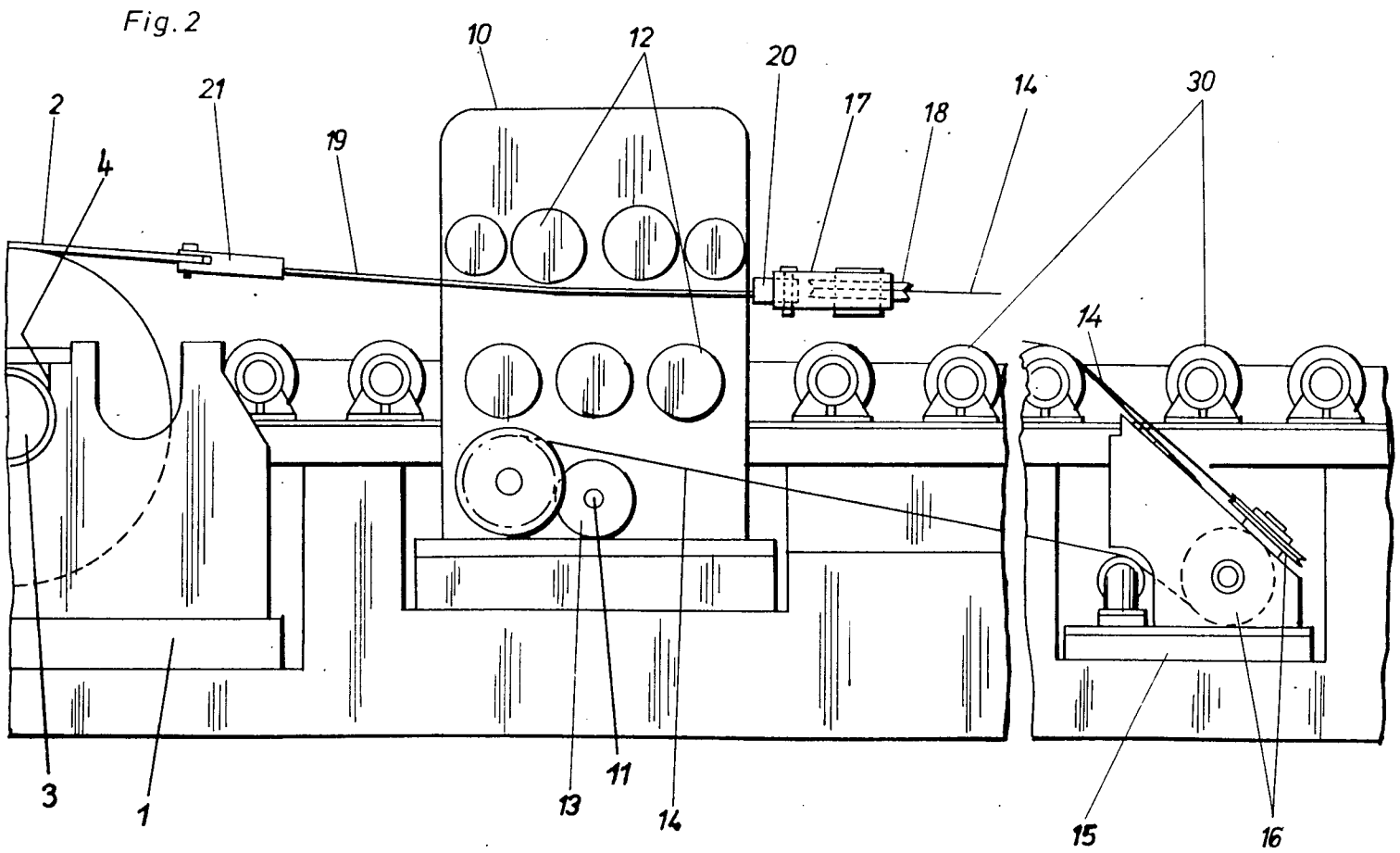
FIG. 2 shows an enlarged detail of FIG. 1, in a diagrammatic representation.
Figure 3:
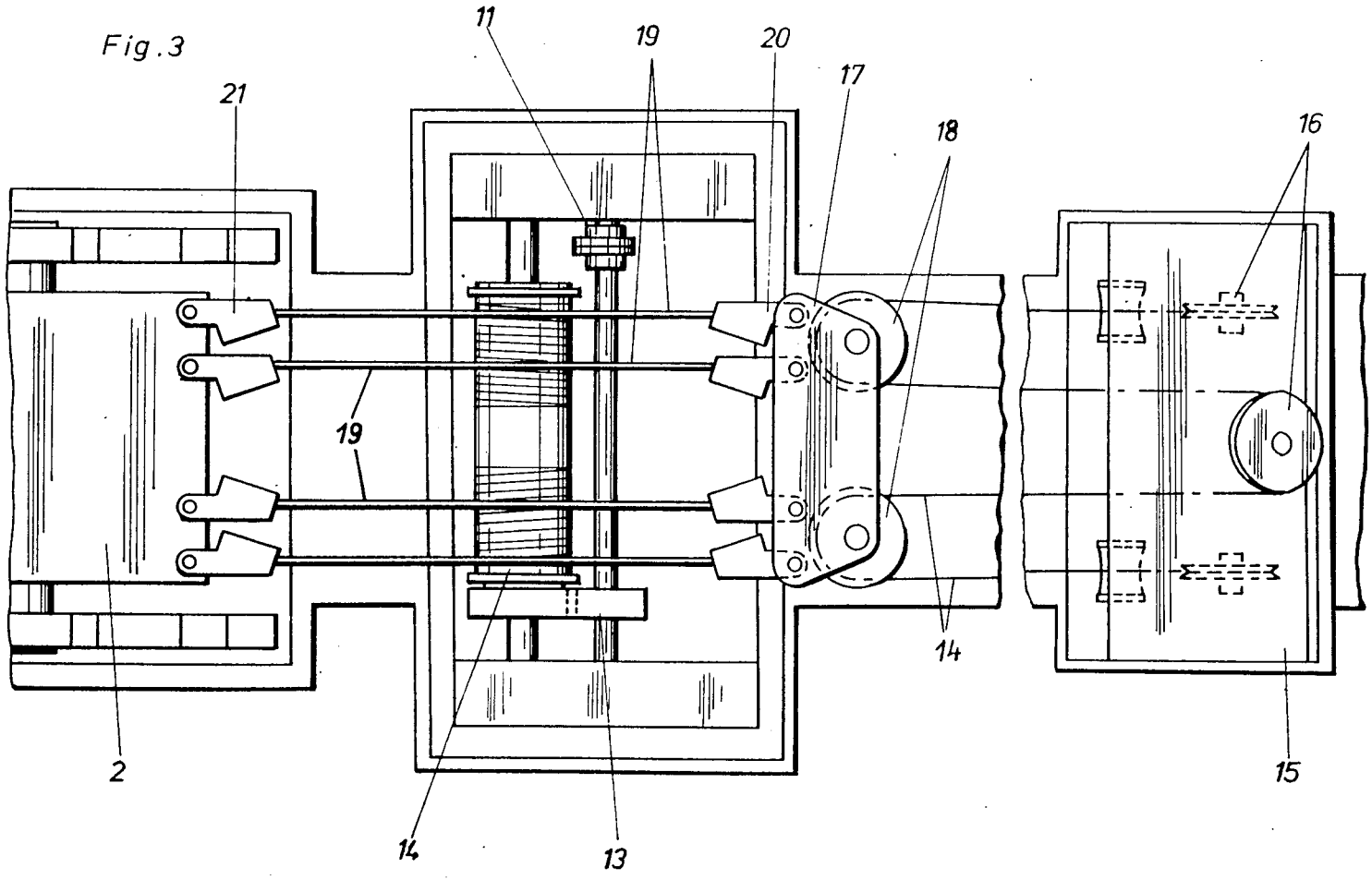
FIG. 3 is a diagrammatic plan view of a part of the apparatus of FIG. 1.

Referring now to the drawings in detail, the apparatus according to FIGS. 1 to 3 includes a roller truing machine 10, of known construction, which is followed by a roller conveyer 30 and is preceded by a coil support frame 1. The coil frame 1 has no drive of any kind, and serves merely for receiving the coil 2, which is provided with a spindle 3, and for supporting the spindle 3. The spindle 3 is inserted, for example by a crane, into the coil 2, which is then placed by the crane into the coil frame 1. The supporting of the spindle 3 in the coil frame 1 is capable of taking up horizontal traction forces, so that the spindle 3 cannot be pulled out of its support by the traction effect occurring during uncoiling, and the coil 2 cannot be lifted out of the coil frame 1. For this purpose, in the illustrated embodiment, the spindle 3 is supported in vertical slots 4 of the coil frame 1.

In a known manner, the roller truing machine 10 has a drive mechanism 11 for a plurality of upper and lower truing rolls 12.

To uncoil the coil 2, a traction means is secured to the strip end, i.e. to the beginning of the coil, as will subsequently be described in greater detail. The traction means extends from the entry side to the exit side of, and through, the roller truing machine 10 between its truing rolls 12, and is drawn through the truing machine 10 with the aid of the truing machine drive mechanism 11, so that by means of the traction means the hot strip beginning is uncoiled from the coil 2 and is drawn into the truing machine 10, where it is grasped by the truing rolls 12, which now draw the hot strip through the truing machine 10 and in doing so completely uncoil the coil 2. In this way coils having, for example, a weight of up to about 40 tons, a width of up to about 2500 mm, and a plate thickness of up to about 60 mm can be uncoiled and trued with simple technical means in an economical dressing apparatus.

In the exemplary embodiment illustrated in FIGS. 1 to 3 a cable line 14 serves as the traction means. The cable line 14 is attached to the beginning of the coil 2, and is conducted between the truing rolls 12 to a cable line drive 13 arranged on the exit side of the roller truing machine 10, so that by means of the cable line the coil is uncoiled, and the beginning of the coil or strip is drawn into the roller truing machine 10 and is threaded between the truing rolls 12. The terms cable line and draw cable as used above and hereinafter refer, within the meaning of the present invention and description, not only to traction devices having a cable, but also to those having a chain or the like as a traction or pulling element.

In an especially advantageous manner, for the drive of the cable line 14 the drive mechanism 11 of the roller truing machine 10 is provided with a drive 13 for the cable line 14 or for its cable drum, so that in a simple and cost-saving manner the uncoiling of the coil 2 takes place with the aid of the truing machine drive mechanism 11, and no additional drive and energy expenditure are necessary for this purpose. To generate the requisite traction forces, the cable line 14 can be provided, for example, with a transmission gearing. In the exemplary embodiment illustrated in FIGS. 1 to 3, the cable line 14 is formed in an especially advantageous manner as a block and tackle system. From the cable drum of the cable line drive 13, arranged in the roller truing machine 10, a draw cable 14 is guided beneath the roller conveyer 30 to a cable deflector or guide arrangement 15, which is likewise disposed below the roller conveyer 30 and has several cable pulleys 16 which form the fixed block of the system. From the fixed block 15, 16, the cable runs lead over the rollers of the roller conveyer 30 to the free block 17, 18 of the system, which is formed by a draw cable crosspiece 17 which can be attached to the beginning of the coil 2 and has several cable pulleys 18. To facilitate operation of the apparatus, the draw cable crosspiece 17 is guided, at the beginning of the uncoiling process, only to directly at the exit side of the roller truing machine 10. The attachment of the free block 17, 18 to the beginning of the coil 2 is effected by securing several cable pieces 19 to the draw cable crosspiece 17 by means of cable joints 20. The draw cable pieces 19 are brought from the exit side to the entry side of the roller truing machine 10, between its truing rolls 12, to the coil 2. To secure the ends of the cable pieces 19, which are provided with cable joints 21, the strip beginning of the coil is provided with holes, and bolts are inserted through these holes and through the cable joints 21. In this way, a uniform distribution of the traction force is achieved over the width of the coil 2.

While in the known, conventional uncoiling units the coil is inserted into an unwinding reel, which is provided with a drive and drives the uncoiled strip from the front into a truing machine, in the apparatus according to the present invention the coil is inserted into a driveless coil frame, and the strip is drawn off from the coil from behind through the truing machine by means of the truing machine drive, and is drawn into the truing machine.

Figure 4:
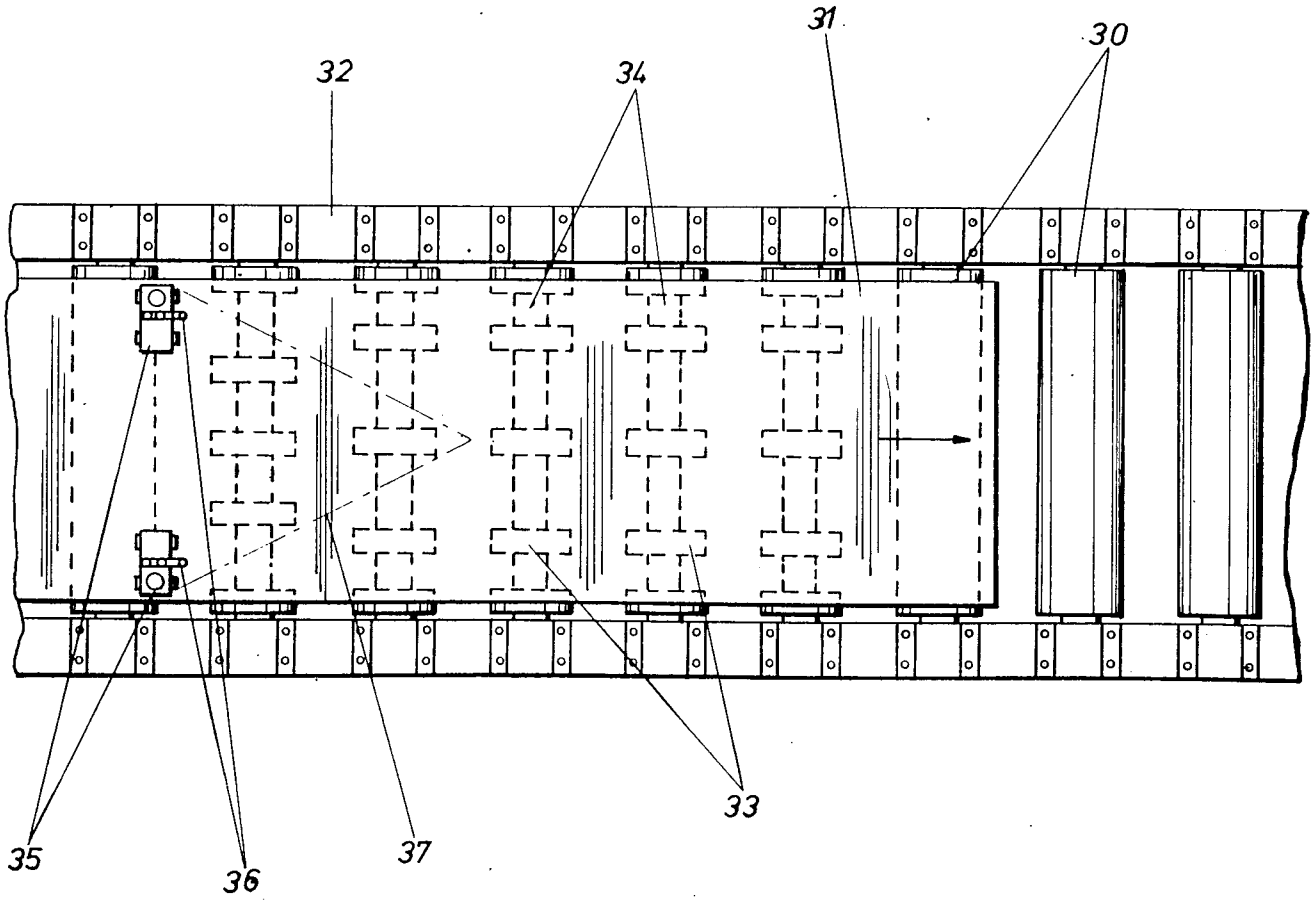
FIG. 4 is a diagrammatic plan view of another part of the apparatus of FIG. 1.

To continuously cut the trued strip issuing from the roller truing machine 10, the roller conveyer 30 is provided with a cutting unit (FIGS. 1 and 4). For this purpose, the portion of the roller conveyer 30 disposed behind the cable guide arrangement 15 is formed as the cutting unit 32 and is provided not with relatively wide rollers to receive the trued strip 31, but with relatively narrow disks 33 which are exchangeably mounted on their spindles 34 and can be arranged at any desired distance from one another. For cutting the strip 31 to length, the cutting unit 32 further comprises a flame cutter arrangement 35 having at least one flame cutter. In the illustrated exemplary embodiment, the flame cutter arrangement 35 has two flame cutters 36 which work simultaneously from the side edges to the middle of the strip 31 and effect the transverse cutting of the strip 31 into plates of the desired size. The flame cutters 36 are movable not only in synchronism with the speed of movement of the strip 31, in the longitudinal or transport direction of the latter, but are also at the same time movable transversely of the strip 31 in its working direction. In accordance on the one hand with the working speed of the flame cutters 36, and on the other with the speed of transport of the strip 31, the simultaneous longitudinal and transverse movement of the flame cutters 36 in relation to the disks 33 and spindles 34 therefore results in an oblique movement 37. Accordingly, the disks 33 are arranged on the spindles 34 in such a way that no disks 33 lie below the path 37 of movement and therefore cannot be damaged by the flame cutters 36.

Figure 5:
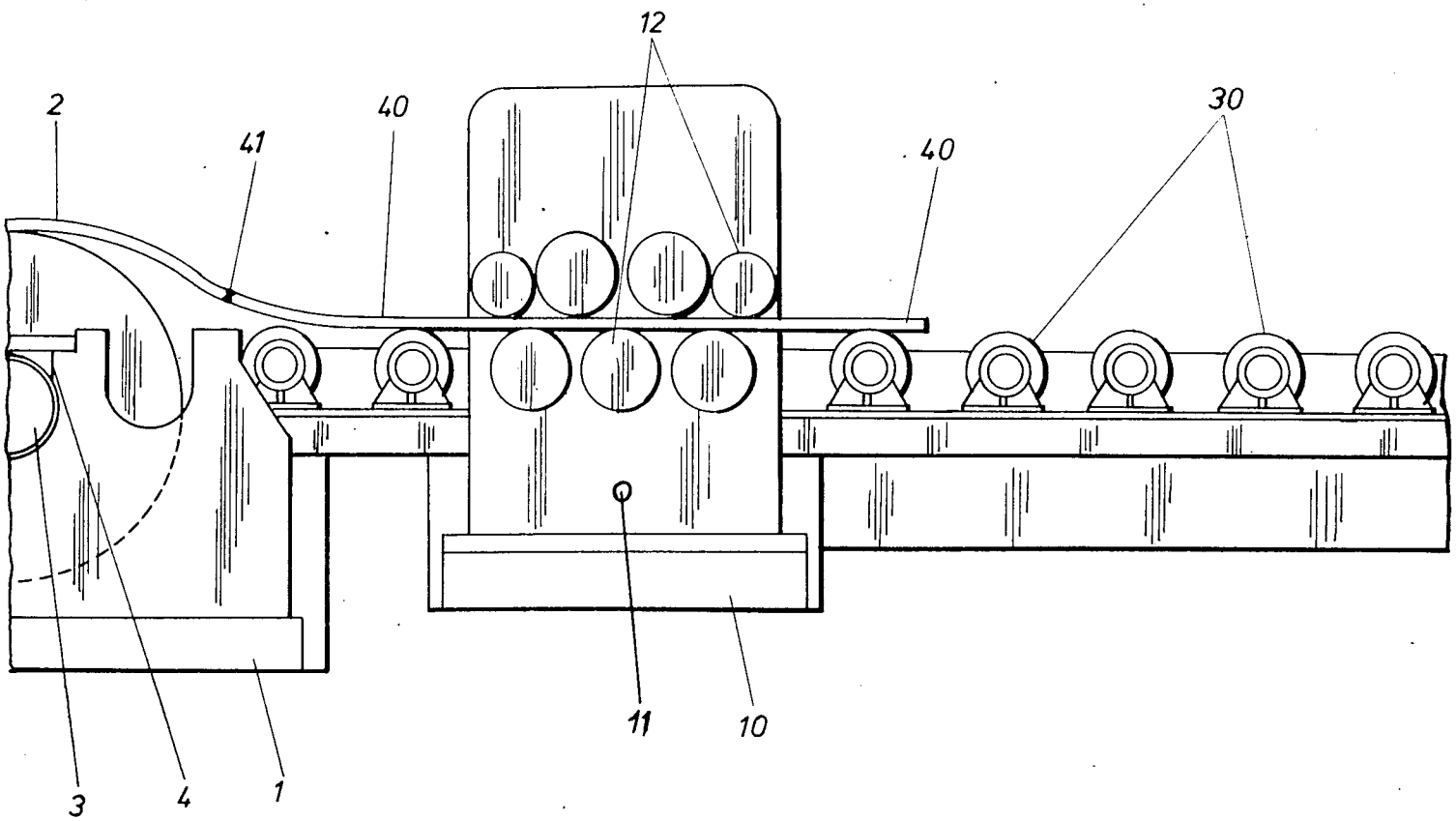
FIG. 5 is a diagrammatic representation of a second exemplary embodiment of an inventive apparatus.

The apparatus according to FIG. 5 differs from the embodiment according to FIGS. 1 to 3 essentially in the omission of the cable line along with the cable line drive, the cable guide arrangement, the cable line crosspiece, etc. Instead, as traction means there is used a traction plate 40 which extends from the entry side to the exit side of the roller truing machine 10 between the truing rolls 12, and which is secured to the beginning of the coil 2. By way of example, the traction plate 40 can be welded via the weld seam 41 to the hot strip of the coil 2, and can subsequently be separated again in the cutting unit 32 by means of the flame cutting arrangement 35 after the uncoiled hot strip has run through the roller truing machine 10. It is possible to use, for example, as a traction plate a piece of hot strip which was previously uncoiled from a coil, trued in the truing machine 10, and severed in the cutting unit 32. Alternatively, it is possible, for example, to halt the truing machine when a coil has just been uncoiled and, before the end of this hot strip is drawn into the roller truing machine, to then take the spindle 3 out of the coil frame 1 and place a new coil 2 with a spindle 3 into the coil frame 1; the end of the hot strip of the preceding coil can then be welded to the beginning of the next coil, so that thus the hot strip end of one coil is used as the traction plate 40 for the next coil. The truing machine drive mechanism 11, and the truing rolls 12, are formed as a drive system for the traction plate 40 in such a way that the truing rolls 12 driven by the truing machine drive mechanism 11 are able to transmit the requisite traction force to the traction plate 40 in order to draw the latter through the truing machine 10 and in doing so to uncoil the hot strip from the coil 2 and draw it into the truing machine. The traction plate 40 and the hot strip of the coil 2 which is to be uncoiled can have different widths and thicknesses. In this case, the adjustable distance between the upper and lower truing rolls 12 is first set to the thickness of the traction plate 40; upon entry of the uncoiled hot strip into the roller truing machine 10, the distance is changed by stages to the thickness of the hot strip.

Accordingly, the exemplary embodiment according to FIG. 5 represents a particularly advantageous form of embodiment of the apparatus according to the invention, and renders it possible, with a roller truing machine, without appreciable additional expense, and with technically simple and cheap means, to uncoil and true coils of scrap value at favorable cost, and to process them into salable material.

Figure 6:
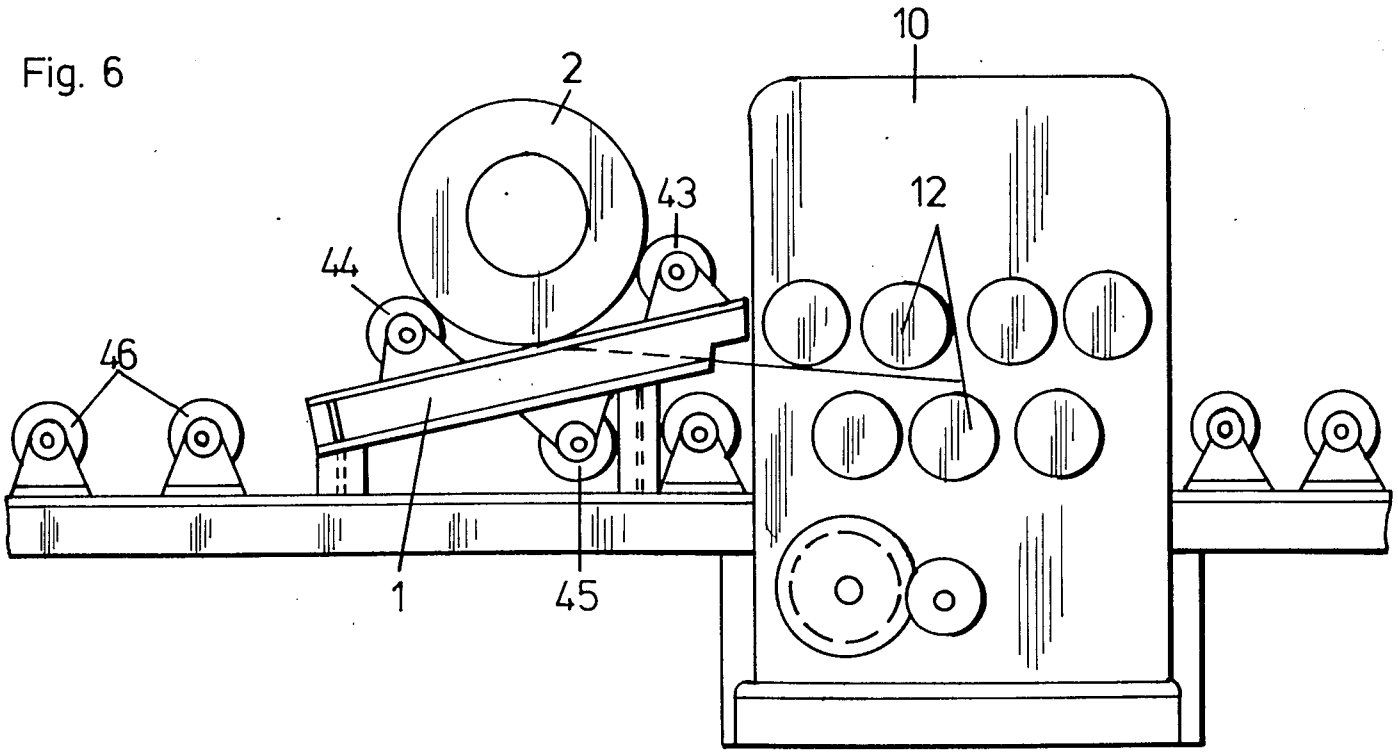
FIGS. 6 to 8 show modified embodiments of a part of the apparatus according to FIG. 1.

In the case of the coil frame 1 in FIGS. 1 and 2, the spindle 3 must be inserted into the coil 2, and the coil 2 is rotatably supported about its axis on the spindle 3 in such a way that the coil frame 1 is capable of taking up the traction forces acting upon the hot strip during uncoiling of the coil 2. FIG. 6 shows an exemplary embodiment in which the coil 2 is rotatably mounted in the coil frame 1 without a spindle. The support comprises support rollers 43, 44,45 which carry the coil 2 and are arranged in such a way that the coil frame 1 is capable of taking up the traction forces exerted upon the hot strip by the truing rolls 12 of the roller truing machine 10.

According to a further feature of the present invention, the coil 2 can first be partially uncoiled in a separate first coil frame in a manner which will subsequently be described in greater detail. The coil 2 is then inserted, for example by means of a crane, with or without a spindle 3, into the second coil frame 1, arranged before the roller truing machine 10, of FIG. 1 and in FIG. 6. The uncoiled beginning of the strip is introduced into the roller truing machine 10 until it is grasped by the truing rolls 12 and is drawn into the roller truing machine 10. In order to facilitate this introduction, in the case of the coil frame 1 in FIG. 6 the support rollers 43, 44 are provided with a drive which can rotate the coil 2 in both directions about its axis in order to raise or lower the uncoiled beginning of the strip.

When the coil 2 is completely uncoiled in the embodiment in FIGS. 1 and 2, the roller truing machine 10 must be halted in order to insert a new coil 2 into the coil frame 1 and to then either secure the beginning of the strip of the new coil to the strip end, of the preceding coil, serving as a traction plate 40, or draw the cable line 14 through between the truing rolls 12 of the roller truing machine 10 and secure it to the beginning of the strip of the new coil, so that the new coil can be uncoiled at least partially and to such an extent that the uncoiled beginning of the strip can be introduced into the roller truing machine 10 until it is grasped by the truing rolls 12 and is drawn into the roller truing machine 10. In order to avoid these down times,and to increase the throughput of the roller truing machine, it is proposed in accordance with the invention to uncoil the coil at least partially in a separate coil frame with the aid of the traction means of a separate traction device. For this purpose, any traction device is suitable which is capable of generating the traction force necessary for uncoiling the coil. A powerful crane, which can be used as a traction device in the manner described below, is in any case generally available for the transport of the heavy coils. Alternatively, for example, a reel or a winch can be used in a manner analogous to that of the cable line drive system 13 which is driven by the drive mechanism 11 of the roller truing machine 10 in FIGS. 1 and 2. A cable, a chain, or any other desired suitable traction means can be used with any one of these traction devices.

In this case, the coil inserted into the separate coil frame can be uncoiled completely and the uncoiled strip can be transported, for example by means of a crane, to the roller truing machine 10 and can be placed upon a roller conveyer 46 which according to FIG. 6 is placed before the roller truing machine. The roller conveyer 46 can be provided with driven rollers in order to transport the uncoiled strip and to introduce the beginning thereof into the roller truing machine 10. It is, however, also possible to use a roller conveyer 46 having the requisite length, at the beginning of which a coil frame (not shown) is arranged, and at the end of which, close to the roller truing machine 10, a traction device is arranged (not shown), for example a cable winch similar to the illustrations in FIGS. 2 and 3, so that the coil is uncoiled out of the coil frame onto the roller conveyer 46, and is then introduced by the roller conveyer 46 into the roller truing machine 10. In the exemplary embodiment of FIG. 6, the coil frame 1 arranged directly before the roller truing machine 10 is formed in such a way, and its support rollers 43, 44, 45 are arranged in such a way, that a hot strip lying on the roller conveyer 46 can be introduced, through the coil frame 1 and between its support rollers 43, 44, 45, into the roller truing machine 10. The length of an uncoiled strip is generally so great that it is as a rule inexpedient, if only on account of the space requirement, to first uncoil the coil completely in the manner described above and to then feed it in the uncoiled condition to the roller truing machine.

Figure 8:
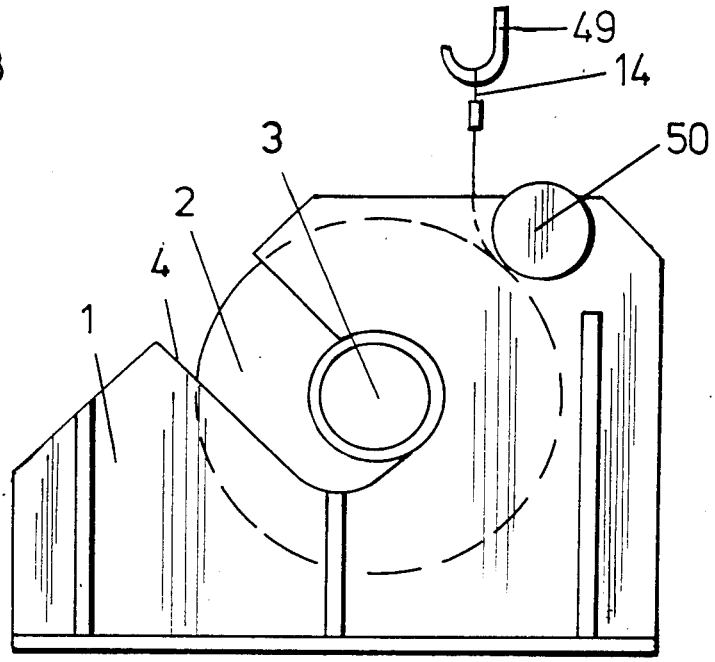
Figure 7:
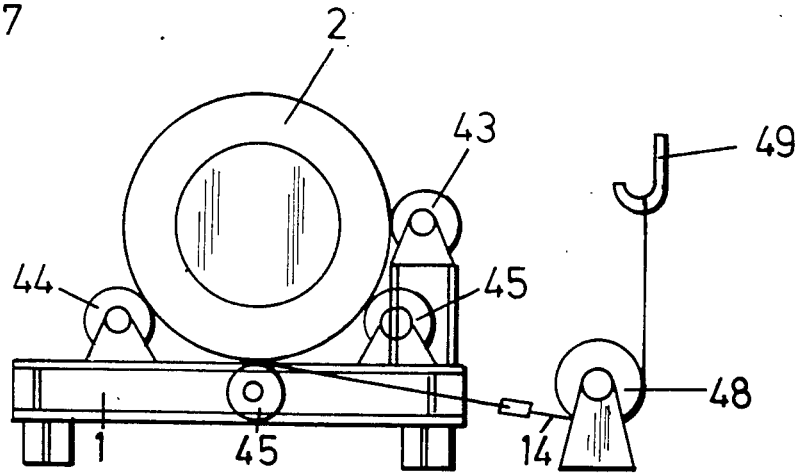

Rather, it will be more advantageous as a rule to uncoil the coil in a first, separate coil frame, by means of the separate traction device, only partially and only so far that the coil, in the manner as described above with reference to FIG. 6, can be inserted into a second coil frame 1 arranged before the roller truing machine 10, with the uncoiled beginning of the strip being introduced at the same time into the roller truing machine 10 until it can be grasped by the truing rolls 12. FIG. 7 shows a coil frame 1 which, analogous to the coil frame 1 in FIG. 6, is provided with support rollers 43, 44, 45 for the coil 2. A cable 14 is secured as a traction means to the beginning of the strip; the cable is guided around a guide pulley 48, and is attached to the load hook 49 of a crane which is used as a traction device. The beginning of the strip is uncoiled with the aid of this hook. The same crane serves for transporting the coil 2 during insertion of the coil into the above-mentioned first coil frame, and also serves for the subsequent transporting of the partly uncoiled coil and its insertion into the second coil frame arranged before the roller truing machine. FIG. 8 shows a coil frame 1 analogous to the coil frame 1 in FIGS. 1 and 2, into which the coil 2 on the spindle 3 is inserted. 50 designates a guide pulley mounted in the coil frame 1. Here again a cable 14 is secured to the beginning of the strip and to the load hook 49 of a crane. The slots 4 in the coil frame 1, which receive the spindle 3 and in which the coil 2 is rotatably mounted with the spindle 3, are arranged and formed in such a way that the coil frame 1 is capable of taking up the crane traction forces which act upon the hot strip. In this way, the coil is partially uncoiled and then again fed to a second coil frame arranged before the roller truing machine.

The present invention is, of course, in no way restricted to the specific disclosure of the specification and drawings, but also encompasses any modifications within the scope of the appended claims.

What I claim is:

1. A method of dressing coils of thick hot rolled strips, especially a coilbox coil; said method comprising the steps of:

placing said coil in a coil support frame and rotatably supporting said coil about its axis in said coil support frame such that said coil support frame takes up traction forces which act upon said hot strip;

securing a traction means of a traction device to the end of said hot strip at the beginning of said coil;

at least partially uncoiling said hot strip from said coil by means of said traction means without necessity for any additional drive and energy expenditure for this purpose and without any appendages being secured thereto;

introducing the thus uncoiled beginning of said hot strip into a roller truing machine until there is grasping of said hot strip by the truing rolls of said roller truing machine and accompanied by drawing of said hot strip into the roller truing machine; and providing said roller truing machine with a drive mechanism; extending said traction means through said roller truing machine from the inlet side to the outlet side thereof between said truing rolls thereof; and drawing said traction means through said roller truing machine with the aid of said drive mechanism, whereby the beginning of said hot strip is unwound from said coil and drawing of said strip proceeds into said roller truing machine.

2. A method of dressing coils of hot rolled strips, especially coilbox coils; said method including the steps of:

placing said coil in a coil support frame in such a way that said coil is rotatably supported about its axis in said coil frame such that the latter takes up traction forces which act upon said hot strip;

securing the traction means of a traction device to the end of said hot strip at the beginning of said coil;

at least partially uncoiling said hot strip from said coil by means of said traction means;

introducing the thus uncoiled beginning of said hot strip into a roller truing machine until said strip is grasped by the truing rolls of said roller truing machine and is drawn into the latter;

providing said roller truing machine with a drive mechanism;

extending said traction means through said roller truing machine from the inlet side to the outlet side thereof between said truing rolls thereof;

drawing said traction means through said roller truing machine with the aid of said drive mechanism, whereby the beginning of said hot strip is unwound from said coil and is drawn into said roller truing machine;

providing, as said traction means, a traction plate; securing said traction plate to the beginning of said coil; extending said traction plate through said roller truing machine from the inlet side to the outlet side thereof between said truing rolls thereof; and drawing said traction plate through said roller truing machine via said truing rolls, which are driven by said drive mechanism.

3. A method of dressing coils of hot rolled strips, especially coilbox coils; said method including the steps of:

placing said coil in a coil support frame in such a way that said coil is rotatably supported about its axis in said coil frame such that the latter takes up traction forces which act upon said hot strip;

securing the traction means of a traction device to the end of said hot strip at the beginning of said coil;

at least partially uncoiling said hot strip from said coil by means of said traction means;

introducing the thus uncoiled beginning of said hot strip into a roller truing machine until said strip is grasped by the truing rolls of said roller truing machine and is drawn into the latter;

providing said roller truing machine with a drive mechanism;

extending said traction means through said roller truing machine from the inlet side to the outlet side thereof between said truing rolls thereof;

drawing said traction means through said roller truing machine with the aid of said drive mechanism, whereby the beginning of said hot strip is unwound from said coil and is drawn into said roller truing machine;

providing, as said traction means, a draw cable;

attaching said draw cable to the beginning of said coil;

providing a cable drive which is driven by said drive mechansim; and guiding said draw cable through said roller truing machine from the inlet side to the outlet side thereof, between said truing rolls thereof, to said cable drive.

4. A method according to claim 3, which includes the steps of providing a subsequent roller conveyer which has a cutting unit with a flame cutting arrangement; and continuously dividing the trued hot strip which issues from said roller truing machine into plates via said flame cutting arrangement.

5. A method of dressing cold coils of hot-rolled strips, especially coilbox coils; said method including the steps of:

placing said coil in a coil support frame in such a way that said coil is rotatably supported about its axis in said coil frame such that the latter takes up traction forces which act upon said hot-rolled strip;

securing a draw cable of a cable device to the end of said hot-rolled strip at the beginning of said coil;

at least partially uncoiling said hot-rolled strip from said coil by means of said draw cable;

introducing the thus uncoiled beginning of said hot-rolled strip into a roller truing machine until said strip is grasped by the truing rolls of said roller truing machine and is drawn into the latter;

providing said roller truing machine with a drive mechanism and driving said cable device by said drive mechanism;

extending said draw cable through said roller truing machine from the inlet side to the outlet side thereof between said truing rolls thereof;

drawing said draw cable through said roller truing machine with the aid of said drive mechanism, whereby the beginning of said hot-rolled strip is unwound from said coil and is drawn into said roller truing machine.

6. A method according to claim 5, which includes the steps of providing a subsequent roller conveyer which has a cutting unit with a flame cutting arrangement; and continuously dividing the trued hot strip which issues from said roller truing machine into plates via said flame cutting arrangement.

7. A method of dressing cold coils of hot-rolled strips, especially coilbox coils; said method comprising the steps of:

placing said coil in a coil support frame and rotatably supporting said coil about its axis in said coil support frame such that said coil support frame takes up traction forces which act upon said hot-rolled strip;

securing a traction means of a traction device to the end of said hot-rolled strip at the beginning of said coil;

at least partially uncoiling said hot-rolled strip from said coil by means of said traction means;

introducing the thus uncoiled beginning of said hot-rolled strip into a roller truing machine until there is grasping of said hot-rolled strip by the truing rolls of said roller truing machine and accompanied by drawing of said hot-rolled strip into the roller truing machine; and providing said traction device with a drive mechanism; extending said traction means through said roller truing machine from the inlet side to the outlet side thereof between said truing rolls thereof; and drawing said traction means through said roller truing machine with the aid of said drive mechanism, whereby the beginning of said hot-rolled strip is unwound from said coil and drawing of said strip proceeds into said roller truing machine.

8. A method according to claim 7, which includes the steps of providing a subsequent roller conveyer which has a cutting unit with a flame cutting arrangement; and continuously dividing the trued hot strip which issues from said roller truing machine into plates via said flame cutting arrangement.

9. A method of dressing cold coils of hot-rolled strips, especially coilbox coils; said method comprising the steps of:

placing said coil in a coil support frame and rotatably supporting said coil about its axis in said coil support frame such that said coil support frame takes up traction forces which act upon said hot-rolled strip;

securing a draw cable of a cable device to the end of said hot-rolled strip at the beginning of said coil;

at least partially uncoiling said hot-rolled strip from said coil by means by said draw cable;

introducing the thus uncoiled beginning of said hot-rolled strip into a roller truing machine until there is grasping of said hot-rolled strip by the truing rolls of said roller truing machine and accompanied by drawing of said hot-rolled strip into the roller truing machine; and providing said cable device with a drive mechanism; extending said draw cable through said roller truing machine from the inlet side to the outlet side therof between said truing rolls thereof; and drawing said draw cable through said roller truing machine with the aid of said drive mechanism, whereby the beginning of said hot-rolled strip is unwound from said coil and drawing of said strip proceeds into said roller truing machine.

10. A method according to claim 9, which includes the steps of providing a subsequent roller conveyer which has a cutting unit with a flame cutting arrangement; and continuously dividing the trued hot strip which issues from said roller truing machine into plates via said flame cutting arrangement.

11. A method of dressing cold coils of hot rolled strips, especially coilbox coils; said method including the steps of:

placing said coil in a coil support frame in such a way that said coil is rotatably supported about its axis in said coil frame such that the latter takes up traction forces which act upon said hot-rolled strip;

securing the traction means of a traction device to the end of said hot-rolled strip at the beginning of said coil;

at least partially uncoiling said hot-rolled strip from said coil by means of said traction means;

introducing the thus uncoiled beginning of said hot-rolled strip into a roller truing machine until said strip is grasped by the truing rolls of said roller truing machine and is drawn into the latter;

providing said traction device with a drive mechanism;

extending said traction means through said roller truing machine from the inlet side to the outlet side thereof between said truing rolls thereof;

drawing said traction means through said roller truing machine with the aid of said drive mechanism, whereby the beginning of said hot strip is unwound from said coil and is drawn into said roller truing machine;

providing, as said traction means, a draw cable;

attaching said draw cable to the beginning of said coil;

providing a cable drive which is driven by said drive mechanism; and guiding said draw cable through said roller truing machine from the inlet side to the outlet side thereof, between said truing rolls thereof, to said cable drive.

12. A method according to claim 11, which includes the steps of providing a subsequent roller conveyer which has a cutting unit with a flame cutting arrangement; and continuously dividing the trued hot strip which issues from said roller truing machine into plates via said flame cutting arrangement.

13. A method of dressing cold coils of hot rolled strips, especially coilbox coils; said method including the steps of:

placing said coil in a coil support frame in such a way that said coil is rotatably supported about its axis in said coil frame such that the latter takes up traction forces which act upon said hot-rolled strip;

securing a draw cable of a cable device to the end of said hot-rolled strip at the beginning of said coil;

at least partially uncoiling said hot-rolled strip from said coil by means of said draw cable;

introducing the thus uncoiled beginning of said hot-rolled strip into a roller truing machine until said strip is grasped by the truing rolls of said roller truing machine and is drawn into the latter;

providing said cable device with a drive mechanism and driving said cable device by said drive mechanism;

extending said draw cable through said roller truing machine from the inlet side to the outlet side thereof between said truing rolls thereof;

drawing said traction means through said roller truing machine with the aid of said drive mechanism, whereby the beginning of said hot-rolled strip is unwound from said coil and is drawn into said roller truing machine.

14. A method according to claim 13, which includes the steps of providing a subsequent roller conveyer which has a cutting unit with a flame cutting arrangement; and continuously dividing the trued hot strip which issues from said roller truing machine into plates via said flame cutting arrangement.

* * * * *